US006965194B2

(12) United States Patent
Uemura et al.

(10) Patent No.: US 6,965,194 B2
(45) Date of Patent: Nov. 15, 2005

(54) VACUUM FLUORESCENT DISPLAY HAVING SLIT LIKE OPENINGS

(75) Inventors: Sashiro Uemura, Mie (JP); Junko Yotani, Mie (JP); Takeshi Nagasako, Mie (JP); Kazuo Kobayashi, Aichi (JP); Hiroyuki Kurachi, Mie (JP)

(73) Assignee: Noritake Co., Ltd., Aichi (JP)

( * ) Notice: Subject to any disclaimer, the term of this patent is extended or adjusted under 35 U.S.C. 154(b) by 371 days.

(21) Appl. No.: 09/933,984

(22) Filed: Aug. 20, 2001

(65) Prior Publication Data

US 2002/0021082 A1 Feb. 21, 2002

(30) Foreign Application Priority Data

Aug. 21, 2000 (JP) ..... 2000-249506

(51) Int. Cl.[7] ..... H01J 1/88; H01J 1/62; H01J 1/304

(52) U.S. Cl. ..... 313/496; 313/495; 313/292; 313/238

(58) Field of Search ..... 313/238, 292, 313/309–311, 336, 351, 495–497, 498, 506, 509; 315/169.1; 445/24

(56) References Cited

U.S. PATENT DOCUMENTS 5,473,218 A 12/1995 Moyer
5,504,387 A 4/1996 Hamagishi et al.
5,541,473 A * 7/1996 Duboc et al. ..... 313/422
5,667,418 A * 9/1997 Fahlen et al. ..... 445/25
5,786,660 A 7/1998 Clerc
6,188,178 B1 * 2/2001 Van Gorkom et al. ... 315/169.1
6,239,547 B1 5/2001 Uemura et al.
6,545,369 B1 * 4/2003 Hatab ..... 257/797
6,563,260 B1 * 5/2003 Yamamoto et al. ..... 313/495
6,624,589 B2 * 9/2003 Kitamura et al. ..... 315/169.3
6,642,639 B2 * 11/2003 Choi et al. ..... 313/309
6,756,729 B1 * 6/2004 Na et al. ..... 313/496

FOREIGN PATENT DOCUMENTS

EP 0951047 A2 3/1999

* cited by examiner

*Primary Examiner*—Karabi Guharay
(74) *Attorney, Agent, or Firm*—Blakely Sokoloff Taylor & Zafman

(57) ABSTRACT

A vacuum fluorescent display includes a front glass member, substrate, phosphor film, an electron-emitting portion, electron extracting electrode, and insulating support member. The front glass member has light transmission properties at least partly. The substrate opposes the front glass member through a vacuum space. The phosphor film is formed on that surface of the front glass member which opposes the substrate and has a predetermined display pattern. The electron-emitting portion is mounted on the substrate to oppose the phosphor film, and has an electron-emitting surface corresponding to the display pattern. The electron extracting electrode is arranged in the vacuum space between the electron-emitting portion and the phosphor film to be spaced apart from the electron-emitting portion by a predetermined distance. The insulating support member is formed on the substrate and adapted to support the electron extracting electrode and divide the electron-emitting surface of the electron-emitting portion into a plurality of regions.

8 Claims, 4 Drawing Sheets

VACUUM FLUORESCENT DISPLAY HAVING SLIT LIKE OPENINGS

BACKGROUND OF THE INVENTION

The present invention relates to a vacuum fluorescent display using a surface electron-emitting source.

Conventionally, as a display component for an audio apparatus or automobile dashboard, a vacuum has been fluorescent display as one of electronic display devices frequently used. In the vacuum fluorescent display, an anode attached with a phosphor and a cathode at a position opposing the anode are arranged in a vacuum vessel, and light emission is obtained by bombarding electrons emitted from the cathode against the phosphor. Generally, a triode structure is used most often, in which a grid for controlling the electron flow is provided between the cathode and anode, so the phosphor selectively emits light.

In a conventional vacuum fluorescent display, a filament (filament cathode) obtained by applying an electron-emitting substance to a thin tungsten wire with a diameter of 7 $\mu$m to 20 $\mu$m is used as a cathode. The filament is attached to an elastic metal thin plate (anchor) fixed by welding to a pair of metal thin plates (filament supports) serving also as electrode leads. When a voltage is applied across the pair of filament supports so that a current is supplied to the filament, the heated filament emits thermoelectrons.

The emitted thermoelectrons are accelerated toward the anode and bombard against a phosphor film formed in a predetermined pattern, thus causing the phosphor to emit light. To turn on/off pattern display, the polarity of the voltage to be applied to the grid provided between the filament and anode is switched.

In the conventional vacuum fluorescent display, because the filament as described above is used as the cathode, the following problems arise.

Since a very thin, fragile filament must be attached in a taut state, it cannot be made long, and the display area cannot be increased. To uniform the luminance of the pattern to be displayed, the emitted electrons must be diffused by the grid. Therefore, it is difficult to obtain a high luminance.

In order to solve the above problems, a vacuum fluorescent display using a surface electron-emitting source as the cathode has been proposed. For example, a vacuum fluorescent display is known in which a surface electron-emitting source is formed as a cathode by printing a paste mixed with needle-like graphite columns with a length of several $\mu$m to several nm and made of an aggregate of carbon nanotubes. In a carbon nanotube, a single graphite layer is cylindrically closed, and a 5-membered ring is formed at the tip of the cylinder. Since the carbon nanotube has a typical diameter of as very small as 4 nm to 50 nm, upon application of an electric field of about $10^9$ V/m, it can field-emit electrons from its tip. The surface electron-emitting source described above utilizes this nature.

FIGS. 7A and 7B show a conventional vacuum fluorescent display using a surface electron-emitting source as the cathode. As shown in FIG. 7A, the conventional vacuum fluorescent display has an envelope 400 constituted by a front glass member 401 which has light-transmission properties at least partly, a substrate 402 opposing the front glass member 401, and a frame-like spacer 403 for hermetically connecting the edges of the front glass member 401 and substrate 402. The interior of the envelope 400 is vacuum-evacuated. A light-emitting portion 410 with a predetermined display pattern is formed on the surface of the front glass member 401 in the envelope 400. The light-emitting portion 410 is constituted by a transparent electrode 411 arranged on the inner surface of the front glass member 401 to have a predetermined display pattern and serving as an anode, and a phosphor film 412 formed on the transparent electrode 411.

An electron-emitting portion 420 using carbon nanotubes as the electron-emitting source is formed on the surface of the substrate 402 in the envelope 400, at a position opposing the phosphor film 412, to have a pattern corresponding to the display pattern. An electron extracting electrode 430 with a large number of electron passing holes 431 is arranged between the electron-emitting portion 420 and phosphor film 412 to be spaced apart from the electron-emitting portion 420 by a predetermined distance. The electron extracting electrode 430 is supported by an insulating support member 440 provided on the edge of the electron-emitting portion 420. A front surface support member 405 vertically hanging toward the substrate 402 is formed on the surface of the front glass member 401 in the envelope 400 so as to surround the light-emitting portion 410. The front surface support member 405 is connected to an intermediate support member 406 formed on the edge of the electron extracting electrode 430.

In this arrangement, when a high voltage is applied across the electron-emitting portion 420 and electron extracting electrode 430 such that the electron extracting electrode 430 is set at a positive potential, the electric field is concentrated to the carbon nanotubes of the electron-emitting portion 420, and electrons are extracted from the tips of carbon nanotubes which are set at a high electric field. The extracted electrons are emitted through the electron passing holes 431 of the electron extracting electrode 430. For this reason, when a positive voltage (acceleration voltage) of, e.g., about +60 V is applied to the transparent electrode 411 with respect to the electron extracting electrode 430, electrons are accelerated toward the transparent electrode 411 and bombard against the phosphor film 412, thus causing it to emit light. Therefore, a predetermined display pattern is displayed.

In the conventional vacuum fluorescent display using a surface electron-emitting source, in order to increase the area of the display pattern, if the areas of the light-emitting portion 410 and electron-emitting portion 420 corresponding to the light-emitting portion 410 are increased, a phenomenon as shown in FIG. 8 occurs, in which only the peripheral portion of a display pattern 415 emits light brightly while light emission at the central portion of the display pattern 415 is dark. More specifically, a high-luminance portion 416 and low-luminance portion 417 are formed on the peripheral and central portions, respectively, of the display pattern 415, thus causing luminance nonuniformity in the display pattern 415.

In order to solve the above problems, the present inventors have studied factors that cause luminance nonuniformity in a large-area display pattern, and reached the following conclusion. According to the conclusion, as shown in FIG. 7B, when some of the electrons emitted from the electron-emitting portion 420 bombard against the insulating support member 440 between the electron-emitting portion 420 and electron extracting electrode 430, a larger number of secondary electrons than the electrons that have bombarded are emitted from the surface of the insulating support member 440, to charge the surface of the insulating support member 440 with a positive potential. When the insulating support member 440 is charged, the field strength in the vicinity of the insulating support member 440 increases, so electrons are easily emitted from the electron-emitting source in the vicinity of the insulating support member 440.

Therefore, the number of electrons bombarding against the peripheral portion of the phosphor film 412 close to the insulating support member 440 increases, and the peripheral portion of the phosphor film 412 emits light brightly. Accordingly, only the peripheral portion of the displayed pattern is bright while the central portion thereof is dark. The present inventors have made studies based on this conclusion, and found that the problems can be solved by actively utilizing charging of the insulating support member 440.

SUMMARY OF THE INVENTION

It is an object of the present invention to provide a vacuum fluorescent display using a surface electron-emitting source, with which a large-area display pattern can be caused to emit light uniformly.

In order to achieve the above object, according to the present invention, there is provided a vacuum fluorescent display comprising a front glass member which has light transmission properties at least partly, a substrate opposing the front glass member through a vacuum space, a phosphor film formed on a surface of the front glass member which opposes the substrate and having a predetermined display pattern, an electron-emitting portion mounted on the substrate to oppose the phosphor film and having an electron-emitting surface corresponding to the display pattern, an electron extracting electrode arranged in the vacuum space between the electron-emitting portion and the phosphor film to be spaced apart from the electron-emitting portion by a predetermined distance, and an insulating support member formed on the substrate and adapted to support the electron extracting electrode and divide the electron-emitting surface of the electron-emitting portion into a plurality of regions.

DESCRIPTION OF THE REFERRED EMBODIMENTS

The present invention will be described in detail with reference to the accompanying drawings.

Figure 1A:
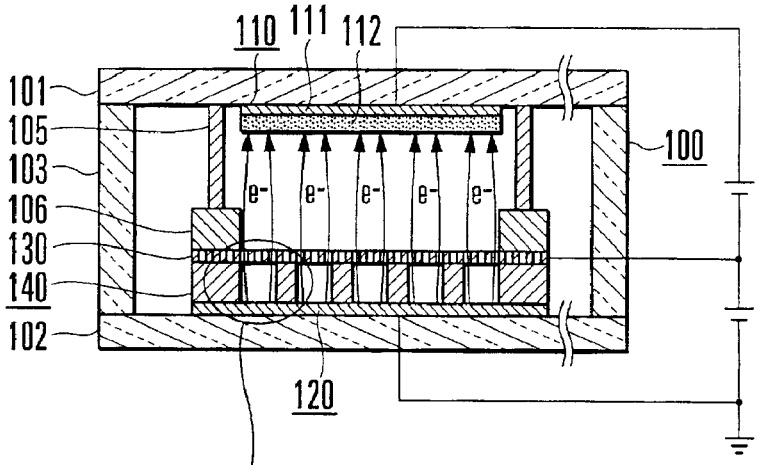
FIG. 1A is a sectional view of a vacuum fluorescent display according to the first embodiment of the present invention.
Figure 1B:
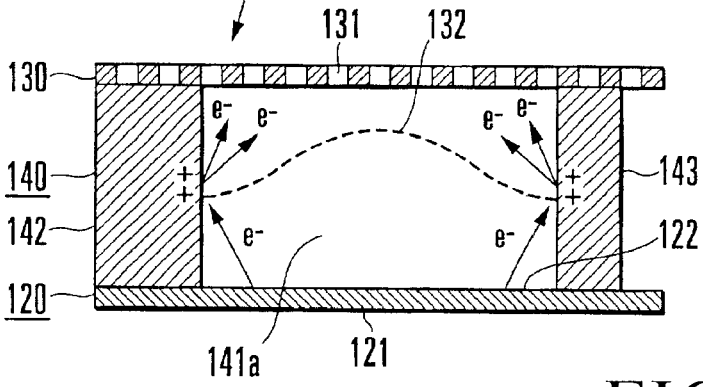
FIG. 1B is an enlarged sectional view of an electron-emitting portion shown in FIG. 1A.

FIGS. 1A and 1B show a vacuum fluorescent display according to the first embodiment of the present invention. As shown in FIG. 1A, the vacuum fluorescent display of this embodiment has an envelope 100 constituted by a front glass member 101 which has light transmission properties at least partly, a substrate 102 opposing the front glass member 101 at a predetermined distance, and a frame-like spacer 103 for hermetically connecting the edges of the front glass member 101 and substrate 102. The interior of the envelope 100 is vacuum-evacuated.

A light-emitting portion 110 with a predetermined display pattern is formed on the surface of the front glass member 101 in the envelope 100. The light-emitting portion 110 is constituted by a transparent electrode 111 arranged on the inner surface of the front glass member 101 to have a predetermined display pattern and serving as an anode, and a phosphor film 112 formed on the transparent electrode 111. An electron-emitting portion 120 is formed on the surface of the substrate 102 in the envelope 100, at a position opposing the phosphor film 112, to have a pattern corresponding to the display pattern.

An electron extracting electrode 130 is arranged between the electron-emitting portion 120 and phosphor film 112 to be spaced apart from the electron-emitting portion 120 by 0.3 mm. An insulating support member 140 is formed between the edges of the electron-emitting portion 120 and electron extracting electrode 130 to separate the electron-emitting portion 120 and electron extracting electrode 130 from each other by a predetermined distance. A front surface support member 105 is formed on the surface of the front glass member 101 in the envelope 100 to vertically hang toward the substrate 102 so as to surround the light-emitting portion 110. An intermediate support member 106 is formed on the edge of the electron extracting electrode 130 to almost correspond to the insulating support member 140, and the front surface support member 105 is connected to the intermediate support member 106.

The front glass member 101, substrate 102, and spacer 103 constituting the envelope 100 are made of soda-lime glass and adhered to each other with low-melting frit glass. As the front glass member 101 and substrate 102, flat glass with a thickness of 1 mm to 2 mm is used. The interior of the envelope 100 is held at a vacuum degree of $10^{-5}$ Pa.

The transparent electrode 111 is formed of an ITO (Indium Tin Oxide) film as a transparent conductive film, and is formed on the inner surface of the front glass member 101 to have a predetermined display pattern by using known sputtering and lift-off. In place of a transparent conductive film, an aluminum thin film with an opening may be formed by using known sputtering and etching, to serve as a transparent electrode. The phosphor film 112 is made of a phosphor that can be excited by a low-speed electron beam and with a predetermined light emission color. The phosphor film 112 is formed by screen-printing a phosphor taste on the transparent electrode 111 to have a predetermined display pattern, and calcining it. As the phosphor that can be excited by a low-speed electron beam, known oxide phosphor or sulfide phosphor generally used in a vacuum fluorescent display can be used. The types of phosphors may be changed for each display pattern so different light emission colors can be obtained, as a matter of course.

The electron-emitting portion 120 is formed in the following manner. First, a bundle paste obtained by dispersing bundles as an aggregate of a plurality of carbon nanotubes in a conductive viscous solution is screen-printed on the substrate 102 so as to correspond to the display pattern.

Subsequently, the entire substrate is calcined to form a conductive film, and the surface of that region of the conductive film which is to serve as the electron-emitting surface is irradiated with a laser beam, so the conductive particles on this surface and carbon nanopolyhedrons in the binder and bundles are removed by evaporation, thereby forming the electron-emitting portion 120. As a result, as shown in FIG. 1B, a large number of carbon nanotubes are uniformly distributed on the surface of bundles 122 exposed from a conductive film 121. The carbon nanotubes dispersed on the surfaces of the bundles 122 serve as the electron-emitting source.

In a carbon nanotube, a single graphite layer is cylindrically closed, and a 5-membered ring is formed at the tip of the cylinder. Since the carbon nanotube has a diameter of as very small as 4 nm to 50 nm, upon application of an electric field of about $10^9$ V/m, it can field-emit electrons. Carbon nanotubes are classified into those with a single-layered structure and a coaxial multilayered structure in which a plurality of graphite layers stacked to form a telescopic structure are cylindrically closed. Either carbon nanotube can be used. The carbon nanotubes may be exposed not by irradiation with a laser beam but by, e.g., selective dry etching using a plasma.

The electron extracting electrode 130 is formed of a metal plate with a large number of electron passing holes 131 through which extracted electrons are allowed to pass, and is arranged in one-to-one correspondence with the electron-emitting portion 120. The electron extracting electrode 130 is formed of a 50-$\mu$m thick stainless steel plate with the electron passing holes 131, each with a diameter of about 100 $\mu$m, which are formed by etching.

Figure 2:
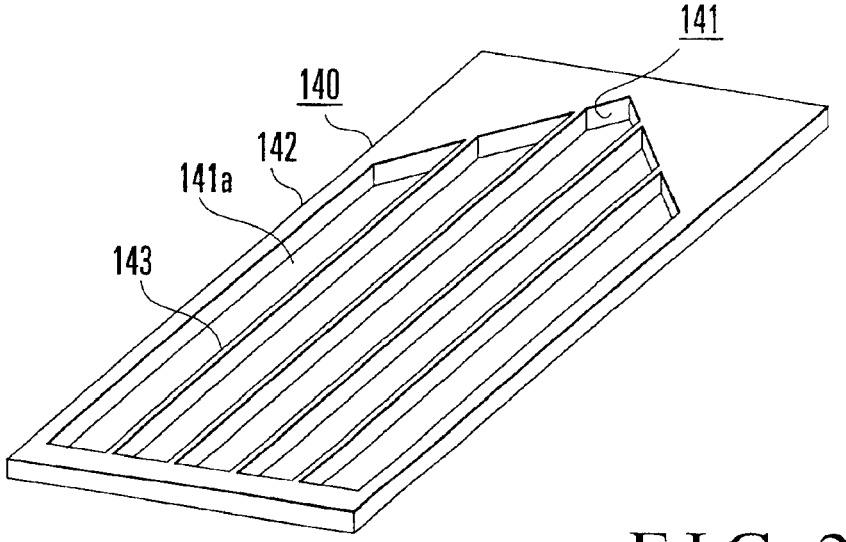
FIG. 2 is a perspective view of an insulating support member shown in FIGS. 1A and 1B.

As shown in FIG. 2, the insulating support member 140 is an insulating substrate 142 having an opening 141 for passing electrons therethrough and with a shape corresponding to the display pattern. The opening 141 of the insulating substrate 142 is divided into a plurality of portions by partitions 143 arranged almost equidistantly to be parallel to each other. More specifically, the opening 141 is comprised of a plurality of slit-like divisional openings 141*a* that make up a plurality of striped divisional spaces parallel to each other. The insulating substrate 142 is mounted on the electron-emitting portion 120.

In the insulating support member 140 of this embodiment, the thickness of the insulating substrate 142 was set to 0.3 mm. The width of the partition 143 was set to 0.2 mm, and the width between partitions was set to 0.8 mm. As the insulating substrate 142, for example, a ceramic substrate made of alumina or the like is used, and the opening 141 is formed by irradiation with a laser beam.

The front surface support member 105 is made of an insulator formed by screen-printing an insulating paste containing low-melting frit glass repeatedly to a predetermined height so as to surround the light-emitting portion 110 on the inner surface of the front glass member 101, and calcining the printed insulating paste. In this embodiment, the front surface support member 105 had a width of 30 $\mu$m to 150 $\mu$m, and a height of about 500 $\mu$m. The intermediate support member 106 is a frame-like insulating member having an opening for passing the electrons emitted from the electron passing holes 131 of the electron extracting electrode 130 therethrough and with a shape corresponding to a display pattern. The intermediate support member 106 is formed of a ceramic substrate made of, e.g., alumina, and its opening is formed by irradiation with a laser beam.

The operation of the vacuum fluorescent display with the above arrangement will be described. When a high voltage is applied across the electron-emitting portion 120 and electron extracting electrode 130 such that the electron extracting electrode 130 is set at a positive potential, the electric field is concentrated to the carbon nanotubes of the electron-emitting portion 120, and electrons ($e^-$) are extracted from the tips of the carbon nanotubes which are in the high electric field. The extracted electrodes are emitted through the electron passing holes 131 of the electron extracting electrode 130. Thus, when a positive voltage (acceleration voltage) of, e.g., about +60 V, is applied to the transparent electrode 111 with respect to the electron extracting electrode 130, the electrons are accelerated toward the transparent electrode 111, to bombard against the phosphor film 112, thereby causing the phosphor film 112 to emit light.

Figure 7A:
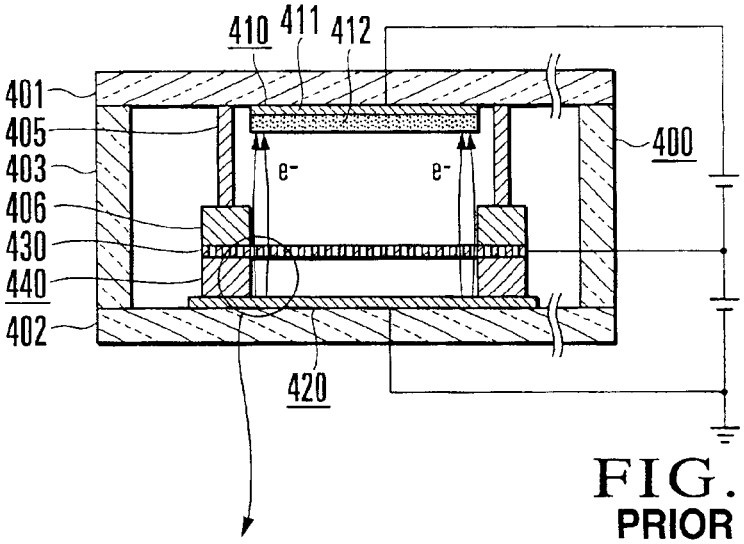
FIG. 7A PRIOR ART
FIG. 7A is a sectional view of a conventional vacuum fluorescent display.
Figure 7B:
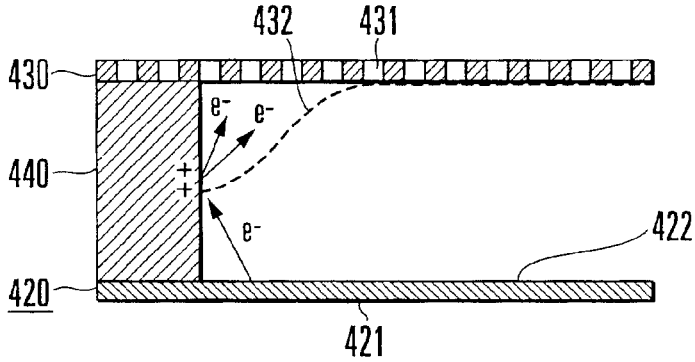
FIG. 7B PRIOR ART
FIG. 7B is an enlarged sectional view of the electron-emitting portion shown in FIG. 5B.
Figure 8:
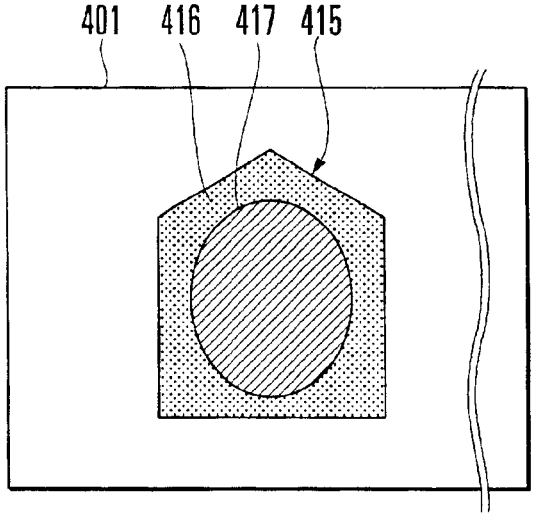
FIG. 8 PRIOR ART
FIG. 8 is a view showing the display state obtained with the vacuum fluorescent display shown in FIGS. 7A and 7B.

In this case, as shown in FIG. 1B, some of the electrons extracted from the tips of the carbon nanotubes bombard against the wall surfaces of the divisional openings 141*a* of the insulating support member 140, so a plurality of secondary electrons are emitted from the wall surfaces. As a result, the wall surfaces of the divisional openings 141*a* are positively charged and their surface potential increases. Since the distance between the charged wall surfaces is short, the field strengths in the divisional openings 141*a* are uniformed. Therefore, a virtual electron extracting electrode 132 formed by synthesis of the potential of the electron extracting electrode 130 and that of the charged wall surfaces of the divisional openings 141*a* is closer to the electron-emitting portion 120 than the actual electron extracting electrode 130, as indicated by a broken line in FIG. 1B. Also, the gradient of the virtual electron extracting electrode 132 becomes more moderate than that of a virtual electron extracting electrode 432 of the conventional vacuum fluorescent display indicated by a broken line in FIG. 7B. Therefore, the display regions corresponding to the respective divisional openings 141*a* have a constant luminance, and all the divisional openings 141*a* have almost equal luminances, thereby providing a large display pattern with a uniform brightness.

Figure 3:
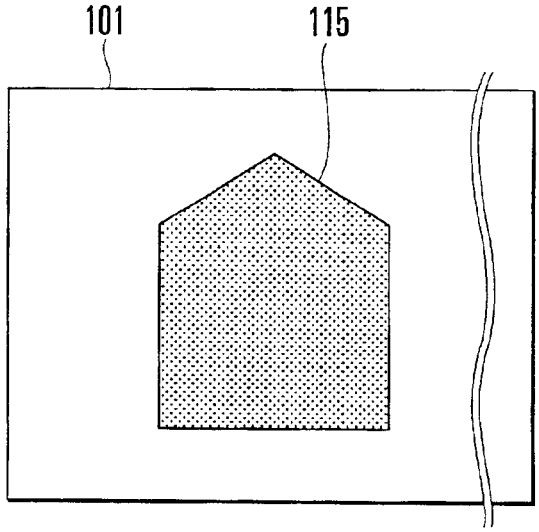
FIG. 3 is a view showing a display state obtained with the vacuum fluorescent display shown in FIG. 1.

According to this embodiment, since electron emission is more uniform than in the conventional vacuum fluorescent display, even if the display pattern has a large area, uniform light emission can be obtained, as shown in FIG. 3. Since the distance between the charged wall surfaces is short, the field strength is higher than that in the conventional vacuum fluorescent display. A larger number of electrons are emitted accordingly, so that a larger emission current can be obtained with a low voltage. If the same voltage and emission current as those of the conventional vacuum fluorescent display suffice, the distance between the electron-emitting portion 120 and electron extracting electrode 130 can be increased, so that inconveniences such as an event of contact of the electron-emitting portion 120 and electron extracting electrode 130 can be reduced. The insulating support member 140 supports the electron extracting electrode 130 not only at the peripheral portion of the electron extracting electrode 130 but also within the region of the electron-emitting portion 120. Hence, the vibration of the electron extracting electrode 130 can be suppressed, so that luminance nonuniformity which occurs when the potential fluctuates due to vibration also decreases.

In the above embodiment, the partitions have heights of 0.3 mm each and an interval of 0.8 mm. It suffices if the partitions have heights of 0.2 mm to 2.0 mm and an interval falling within a range of ½ to 5 times the height.

Figure 4A:
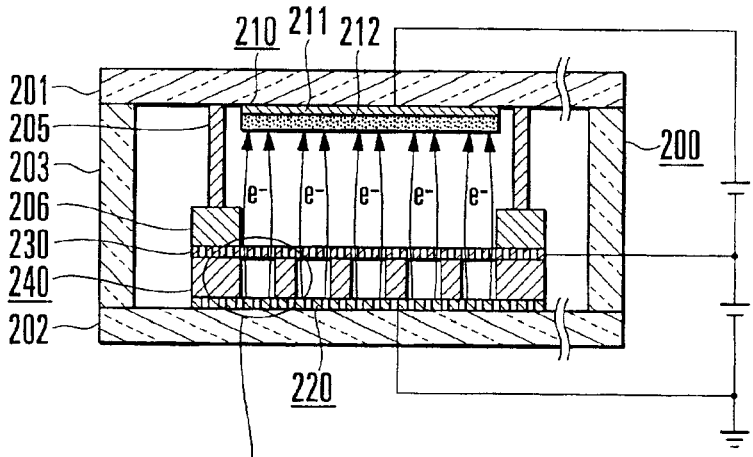
FIG. 4A is a sectional view of a vacuum fluorescent display according to the second embodiment of the present invention.

The second embodiment of the present invention will be described with reference to FIGS. 4A and 4B.

The second embodiment is different from the first embodiment in that its electron-emitting portion 220 is comprised a plate-like metal member 221 having a large number of through holes 221*a* and serving as a growth nucleus for nanotube fibers, and a coating film 222 constituted by a large number of nanotube fibers arranged on the surface of the plate-like metal member 221 and on the inner walls of the through holes 221*a*. The electron-emitting portion 220 is fixed to a substrate 202 with an insulating paste (not shown) containing frit glass. Except for the electron-emitting portion 220, the arrangement of the second embodiment is identical to that described in the first embodiment, and a detailed description thereof will be omitted.

The plate-like metal member 221 is a metal plate made of iron or an iron-containing alloy, and has a grid-like shape because of the through holes 221*a* that form a matrix. The openings of the through holes 221*a* may be of any shape as far as the coating film 222 is distributed uniform on the plate-like metal member 221, and the sizes of the openings need not be the same. For example, the openings may be polygons such as triangles, quadrangles, or hexagons, those formed by rounding the corners of such polygons, or circles or ellipses. The sectional shape of the plate-like metal member 221 between the through holes 221*a* is not limited to a square as shown in FIG. 4B, but may be of any shape such as a circle or ellipse constituted by curves, a polygon such as a triangle, quadrangle, or hexagon, or those formed by rounding the corners of such polygons.

Iron or an iron-containing alloy is used as the material of the plate-like metal member 221, because iron serves as a growth nucleus for carbon nanotube fibers. When iron is selected to form the plate-like metal member 221, industrial pure iron (Fe with a purity of 99.96%) is used. This purity is not specifically defined, and can be, e.g., 97% or 99.9%. As the iron-containing alloy, for example, a 42 alloy (42% of Ni) or a 42-6 alloy (42% of Ni and 6% of Cr) can be used. However, the present invention is not limited to them. In this embodiment, a 42-6 alloy thin plate with a thickness of 50 $\mu$m to 200 $\mu$m was used considering the manufacturing cost and availability.

The nanotube fibers constituting the coating film 222 have thicknesses of about 10 nm or more and less than 1 $\mu$m, and lengths of about 1 $\mu$m or more and less than 100 $\mu$m, and are made of carbon. The nanotube fibers may be single-layered carbon nanotubes in each of which a graphite single layer is cylindrically closed and a 5-membered ring is formed at the tip of the cylinder. Alternatively, the nanotube fibers may be coaxial multilayered carbon nanotubes in each of which a plurality of graphite layers are multilayered to form a telescopic structure and are respectively cylindrically closed, hollow graphite tubes each with a disordered structure to produce a defect, or graphite tubes filled with carbon. Alternatively, the nanotubes may mixedly have these structures.

Such a nanotube fiber has one end connected to the surface of the plate-like metal member 221 or the wall of a through hole and is curled or entangled with other nanotube fibers to cover the surface of the metal portion constituting the grid, thereby forming the cotton-like coating film 222. In this case, the coating film 222 covers the plate-like metal member 221 with the thickness of 50 $\mu$m to 200 $\mu$m by a thickness of 10 $\mu$m to 30 $\mu$m to form a smooth curved surface. Reference numeral 211 denotes a transparent electrode; 212, a phosphor film; and 230, an electron extracting electrode with electron passing holes 231.

In this embodiment, the following thermal CVD (Chemical Vapor Deposition) was used as a method of manufacturing the electron-emitting portion 220. First, the plate-like metal member 221 is set in the reaction chamber, and the interior of the reaction chamber is evacuated to vacuum. Then, methane gas and hydrogen gas, or carbon monoxide gas and hydrogen gas are introduced into the reaction chamber at a predetermined ratio, and the interior of the reaction chamber is held at 1 atm. In this atmosphere, the plate-like metal member 221 is heated for a predetermined period of time by an infrared lamp to grow the carbon nanotube fiber coating film 222 on the surface of the plate-like metal member 221 and the inner wall surfaces of the through holes 221*a* constituting the grid. With thermal CVD, carbon nanotube fibers constituting the coating film 222 can be formed on the plate-like metal member 221 in a curled state.

Figure 4B:
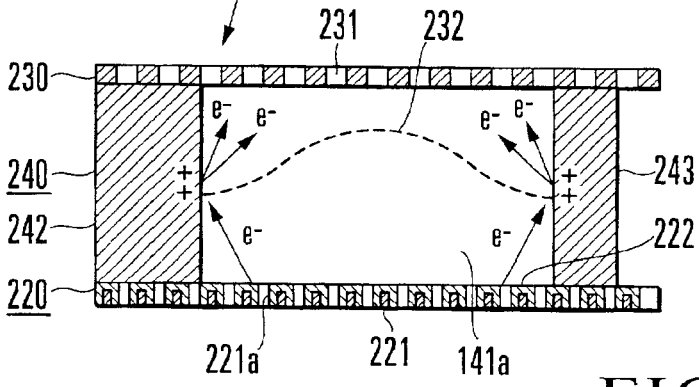
FIG. 4B is an enlarged sectional view of an electron-emitting portion shown in FIG. 4A.

When fixing the electron-emitting portion 220 to the substrate 202, if the thickness of the insulating paste is small, the fixing surface side of the coating film 222 formed on the plate-like metal member 221 may be removed in advance, as shown in FIG. 4B.

In this embodiment, electrons ($e^-$) are extracted from the nanotube fibers constituting the coating film 222 of the electron-emitting portion 220 so the phosphor film 212 emits light, in the same manner as in the first embodiment. At this time, a virtual electron extracting electrode 232 is closer to the electron-emitting portion 220 than the actual electron extracting electrode 230, as indicated by a broken line in FIG. 4B, and its gradient becomes more moderate than in the conventional case.

Figure 5A:
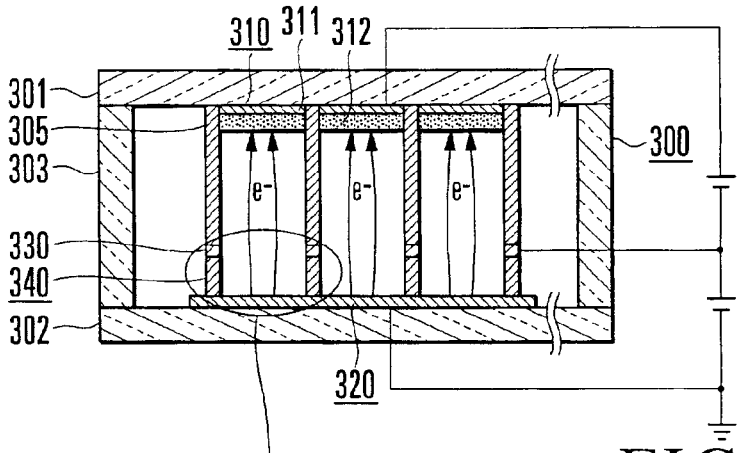
FIG. 5A is a sectional view of a vacuum fluorescent display according to the third embodiment of the present invention.

The third embodiment of the present invention will be described with reference to FIGS. 5A and 5B.

The third embodiment is different from the first embodiment in that an insulating support member 340 is constituted by a wall-like structure 342 and partitions 343 vertically standing on an electron-emitting portion 320, that an electron extracting electrode 330 is constituted by conductive films formed on the tops of the wall-like structure 342 and partitions 343, and that a front surface support member 305 is arranged in contact with the electron extracting electrode 330. Except for the electron extracting electrode 330 and insulating support member 340, the arrangement of the third embodiment is identical to that described in the first embodiment, and a detailed description thereof will be omitted.

Figure 6:
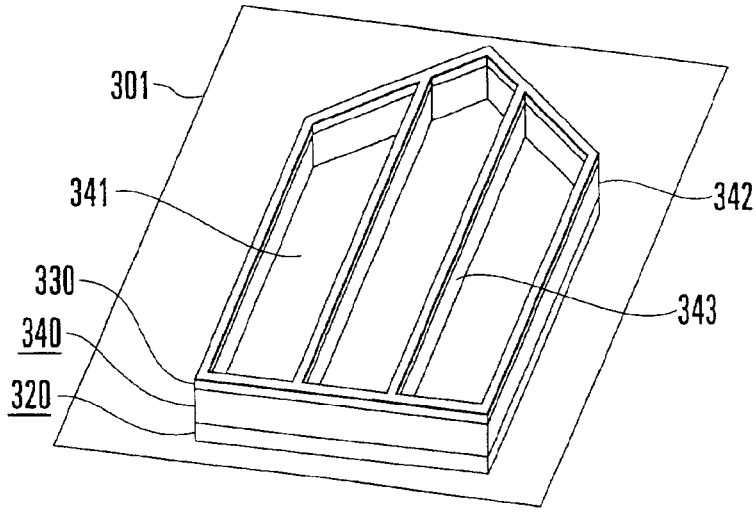
FIG. 6 is a perspective view of the insulating support member shown in FIGS. 5A and 5B.

As shown in FIG. 6, the insulating support member 340 is constituted by the wall-like structure 342 formed on the edge of the electron-emitting portion 320, and the partitions 343 formed in the region of the electron-emitting portion 320. The partitions 343 and wall-like structure 342 are connected to each other to partition the electron-emitting surface of the electron-emitting portion 320 into slit-like regions with almost the same width. Divisional spaces are formed to correspond to the slit-like regions. The insulating support member 340 is made of an insulator formed by screen-printing an insulating paste containing low-melting frit glass repeatedly to a predetermined height so as to have a predetermined pattern on the electron-emitting portion 320, and calcining the printed insulating paste.

The height of the insulating support member 340 is desirably set low within a range with which discharge does not occur between the electron-emitting portion 320 and electron extracting electrode 330. In this embodiment, the height of the insulating support member 340 was set to about 100 $\mu$m to 200 $\mu$m to correspond to the 20- to 100-$\mu$m thickness of the electron-emitting portion 320. The widths of the wall-like structure 342 and partitions 343 making up the insulating support member 340 were set to 30 μm to 150 μm, and the width between the partitions was set to about 1 mm.

As shown in FIG. 6, the electron extracting electrode 330 is formed of a conductive film formed on the top of the insulating support member 340. This conductive film is formed by screen-printing a conductive paste containing silver or carbon as a conductive material to the top of the insulating support member 340 for a predetermined thickness and calcining the printed paste. For example, an insulating paste corresponding to the pattern of the insulating support member 340 is printed 20 times on the electron-emitting portion 320 of a substrate 302 where the electron-emitting portion 320 is formed. Subsequently, a conductive paste is printed once with the same pattern, and is calcined, thereby integrally forming the insulating support member 340 and electron extracting electrode 330.

Figure 5B:
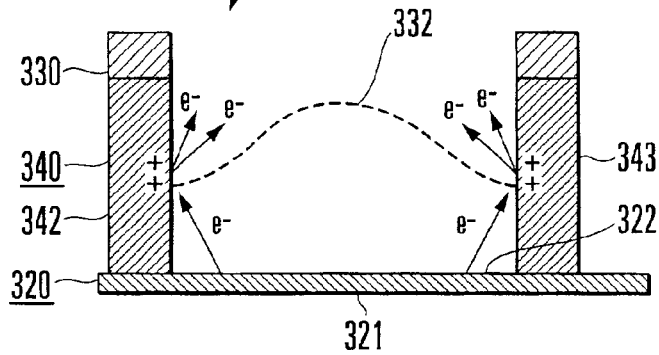
FIG. 5B is an enlarged sectional view of an electron-emitting portion shown in FIG. 5A.

In this embodiment as well, a virtual electron extracting electrode 332 is closer to the electron-emitting portion 320 than the actual electron extracting electrode 330, as indicated by a broken line in FIG. 5B, and its gradient is more moderate than in the conventional case.

The vacuum fluorescent display according to the present invention is not limited to those shown in the embodiments described above, but can be modified in various manners. For example, the electron-emitting portion 320 of the vacuum fluorescent display shown in the third embodiment may be replaced with the electron-emitting portion 220 shown in the second embodiment. In the first and second embodiments, the electron extracting electrodes 130 and 230 may be realized by the conductive films formed on the tops of the insulating support members 140 and 240, as shown in the third embodiment. Conversely, in the third embodiment, the electron extracting electrode 330 may be formed of a metal plate with a large number of electron passing holes, as shown in the first embodiment.

When the electron extracting electrode is formed of a metal plate with a large number of electron passing holes, the insulating support member may be formed of a member identical to the conventional one, and partitions formed of another insulating substrate may be arranged on the electron-emitting surface on a region surrounded by the insulating support member. In this case, the same materials may be preferably used so the characteristics of secondary electron emission do not differ.

The arrangement of the partitions of the insulating support member is not limited to those shown in FIGS. 2 and 6, but any arrangement may be employed as far as the partitions are arranged to divide the electron-emitting surface of the electron-emitting portion into a plurality of electron-emitting regions with almost the same shape, such that the electron emission amounts of the respective electron-emitting surfaces or the uniformities in the emission surfaces become almost equal. For example, the partitions may be arranged such that individual electron-emitting regions surrounded by the partitions have either a circular, rectangular, or honeycomb shape. The light-emitting portion may be formed by arranging a phosphor on the front glass member and forming a metal back film serving as an anode on the surface of the phosphor.

A plurality of sets of electron-emitting portions and phosphor films are provided in the vacuum space, and are arranged in one-to-one correspondence for each display pattern.

As has been described above, according to the present invention, since the insulating support member has partitions that divide the electron-emitting surface of the electron-emitting portion into a plurality of regions, electron emission is uniformed, and a large-area display pattern can be caused to emit light uniformly.

What is claimed is:

1. A vacuum fluorescent display comprising:

a front glass member which has light transmission properties at least partly;

a substrate opposing said front glass member through a vacuum space;

a phosphor film formed on a surface of said front glass member which opposes said substrate and having a predetermined large-area display pattern;

a surface electron-emitting portion comprising a coating film formed of a large number of nanotube fibers, said surface electron-emitting portion is mounted on said substrate to oppose said phosphor film and having an electron-emitting surface corresponding to the large-area display pattern;

an electron extracting electrode arranged in the vacuum space between said surface electron-emitting portion and said phosphor film to be spaced apart from said surface electron-emitting portion by a predetermined distance; and an insulating support member formed on said substrate having partitions for supporting said electron extracting electrodes and dividing the electron-emitting surface of said surface electron-emitting portion into a plurality of regions, said partitions being made of material from which a larger number of secondary than that of bombarded electrons are emitted;

wherein said partitions divide the electron-emitting surface of said surface electron-emitting portion into a plurality of electron-emitting regions of almost the same shape;

said insulating support member has an opening corresponding to the large-area display pattern, and said partitions are integrally formed with said insulating support member so as to divide the opening into a plurality of slit-like divisional openings.

2. A display according to claim 1, wherein the electron-emitting surface of said surface electron-emitting portion is divided into a plurality of stripe regions parallel to each other.

3. A display according to claim 1, wherein said electron extracting electrode is formed of a mesh-like metal plate, and is supported by said insulating support member to be spaced apart from the electron-emitting surface by a predetermined distance.

4. A display according to claim 1, wherein said electron extracting electrode is formed of a conductive film formed at a top of said insulating support member.

5. A display according to claim 1, wherein said surface electron-emitting portion is formed of a larger number of carbon nanotubes formed of cylindrical graphite layers.

6. A display according to claim 1, wherein said surface electron-emitting portion comprises a plate-like metal member having a large number of through holes and serving as a growth nucleus for nanotube fibers, and a coating film formed of a large number of nanotube fibers formed on a surface of the metal member and on walls of the through holes.

7. A display according to claim 1, wherein said surface electron-emitting portion and said phosphor film comprise a plurality of sets of electron-emitting portions and phosphor films provided in the vacuum space in one-to-one correspondence for each display pattern.

8. A vacuum fluorescent display comprising:

a front glass member which has light transmission properties at least partly;

a substrate opposing said front glass member through a vacuum space;

a phosphor film formed on a surface of said front glass member which opposes said substrate and having a predetermined large-area display pattern;

a surface electron-emitting portion comprising a coating film formed of a large number of nanotube fibers, said surface electron-emitting portion is mounted on said substrate to oppose said phosphor film and having an electron-emitting surface corresponding to the large-area display pattern;

an electron extracting electrode arranged in the vacuum space between said surface electron-emitting portion and said phosphor film to be spaced apart from said surface electron-emitting portion by a predetermined distance; and an insulating support member formed on said substrate having partitions for supporting said electron extracting electrodes and dividing the electron-emitting surface of said surface electron-emitting portion into a plurality of regions, said partitions being made of material from which a larger number of secondary electrons than that of bombarded electrons are emitted;

wherein said partitions are arranged substantially equidistantly to be parallel to each other; and wherein the partitions have heights of 0.2 mm to 2.0 mm each and are arranged at an interval ½ to 5 times the height.

* * * * *